United States Patent [19]

Branitzky

[11] 3,999,913

[45] Dec. 28, 1976

[54] CONCRETE SHAPING AND STRESSING MEANS

[76] Inventor: Abraham Branitzky, 18340 Cherry Creek Drive, Homewood, Ill. 60430

[22] Filed: Nov. 27, 1974

[21] Appl. No.: 527,685

[52] U.S. Cl. ..... 425/111; 249/18; 249/81; 249/126; 249/147

[51] Int. Cl.[2] ..... B28B 23/06

[58] Field of Search ..... 52/223 L; 264/228–229; 425/111; 249/13, 18, 93, 94, 120, 122, 126, 146–147, 79–81

[56] References Cited

UNITED STATES PATENTS

| | | | |
|---|---|---|---|
| 1,592,070 | 7/1926 | Blake | 249/126 |
| 2,971,237 | 2/1961 | Graham | 249/13 |
| 3,161,938 | 12/1964 | Graham | 249/13 |
| 3,182,948 | 5/1965 | Lawrence | 249/190 |
| 3,491,417 | 1/1970 | Haller et al. | 249/126 |
| 3,767,153 | 10/1973 | Haller et al. | 219/158 |

FOREIGN PATENTS OR APPLICATIONS

| | | | |
|---|---|---|---|
| 705,829 | 3/1965 | Canada | 425/111 |
| 704,090 | 2/1954 | United Kingdom | 425/111 |
| 1,060,691 | 3/1967 | United Kingdom | 249/129 |

*Primary Examiner*—Richard B. Lazarus
*Assistant Examiner*—John McQuade

[57] ABSTRACT

A lower longitudinal carriage has a stressing portal at one end and an anchor portal at its other end. The vertical members of the portals have vertical slots to allow longitudinal stressing bars to pass through at any place along the vertical height. An upper longitudinal carriage is spaced above the lower carriage and in turn supports tiers of rectangular mold forms in which the lowest form rests upon a rigid support and each successive mold form rests upon the hardened slab which has been cast in the mold form below it, separated by a durable plastic sheet.

Longitudinal stressing rods run through the portals and the mold forms at any height appropriate for the forms. Stressing rods running transversely to the longitudinal rods, run through vertical slots in vertical members in end bents and one or more side bents which slide between the stressing portal and the anchor portal and in the space between the upper and lower carriages.

A universal prestressed concrete slab is produced by the apparatus, comprising a thin web surrounded by a rectangular frame like flange. Knock-out pins in the mold form position a cavity-forming wooden form or pan in the mold form.

12 Claims, 12 Drawing Figures

10
11
12
13
14
15
16
17
18
21
22
23
24
28
29
30
33
2

CONCRETE SHAPING AND STRESSING MEANS

This invention relates to an apparatus for molding prestressed concrete forms and more particularly to an apparatus for molding multiple forms at or near the construction site.

BACKGROUND OF THE INVENTION

In prestressed reinforced concrete form construction, a significant limiting factor is the weight of the concrete forms and their translation into transportation costs. For this reason large pre-cast concrete forms, such as those comprising a substantial part of a wall or a floor, rarely can be justified at distances beyond 250 to 300 miles from their source. Larger concrete forms therefore tend to be poured in place at the construction site. Pre-cast, prestressed concrete forms have advantages over concrete poured in place.

The initial tension in the steel rods is translated into internal compression in the concrete. Therefore, there are no cracks in the concrete slab due to expansion and contraction caused by temperature changes, and the member can be thinner, saving material.

However, another limiting factor is the combined cost of the equipment needed to pre-cast and reinforce the concrete forms and the cranes needed to raise them to vertical orientation at the construction site and to move them into place. Thereafter other equipment is needed to brace and anchor the concrete forms in position during the course of construction. The problem is intensified when a multiple of pre-casting molds are needed to cast multiple shapes for walls and floors of structure under construction.

Hence, the purpose of this invention is to overcome the cost disadvantages associated with pre-cast, prestressed concrete construction by reducing significantly the labor costs, equipment costs, transportation costs and other costs associated with slow methods of construction with concrete.

Another purpose of the invention is to provide the means for multiple pre-casting of concrete forms at the site.

Another purpose is to provide a single, or limited number of pre-cast concrete forms that can be used for walls, floor and roof.

Another purpose is to provide the means for pre-casting the multi-purpose concrete form at site, thus combining the economics of on-site fabrication and multi-use in one embodiment.

A further purpose of the invention is to provide a means for pre-stressing pre-cast concrete forms with reinforcing rods in both a longitudinal and a transverse direction.

SUMMARY OF THE INVENTION

The above described purposes are accomplished in the present invention by the provision of a lower longitudinal carriage having a stressing portal at one end and an anchor portal at its other end. The vertical members of the portals have vertical slots to allow longitudinal stressing bars to pass through at any place along the vertical height. An upper longitudinal carriage is spaced above the lower carriage and in turn supports tiers of rectangular mold forms in which the lowest form rests upon a rigid support and each successive mold form rests upon the hardened slab which has been cast in the mold form below it, separated by a durable plastic sheet.

Each mold form is made of C-channels which are assembled and disassembled in the apparatus. Longitudinal stressing rods run through the portals and the mold forms at any height appropriate for the forms. Stressing rods running transversely to the longitudinal rods, run through vertical slots in vertical members in end bents and one or more side bents which slide between the stressing portal and the anchor portal and in the space between the upper and lower carriages.

A universal prestressed concrete slab is produced by the apparatus, comprising a thin web surrounded by a rectangular frame-like flange. Knock-out pins in the mold form position a cavity-forming wooden form or pan in the mold form and provide holes through the flange after they are removed. The holes are used for anchor bolts or tie rods for securing the universal slab to adjacent structural elements.

These and other objects and features of the invention will be readily understood from the following detailed description taken together with the drawings.

DETAILED DESCRIPTION

Figures 1, 12:
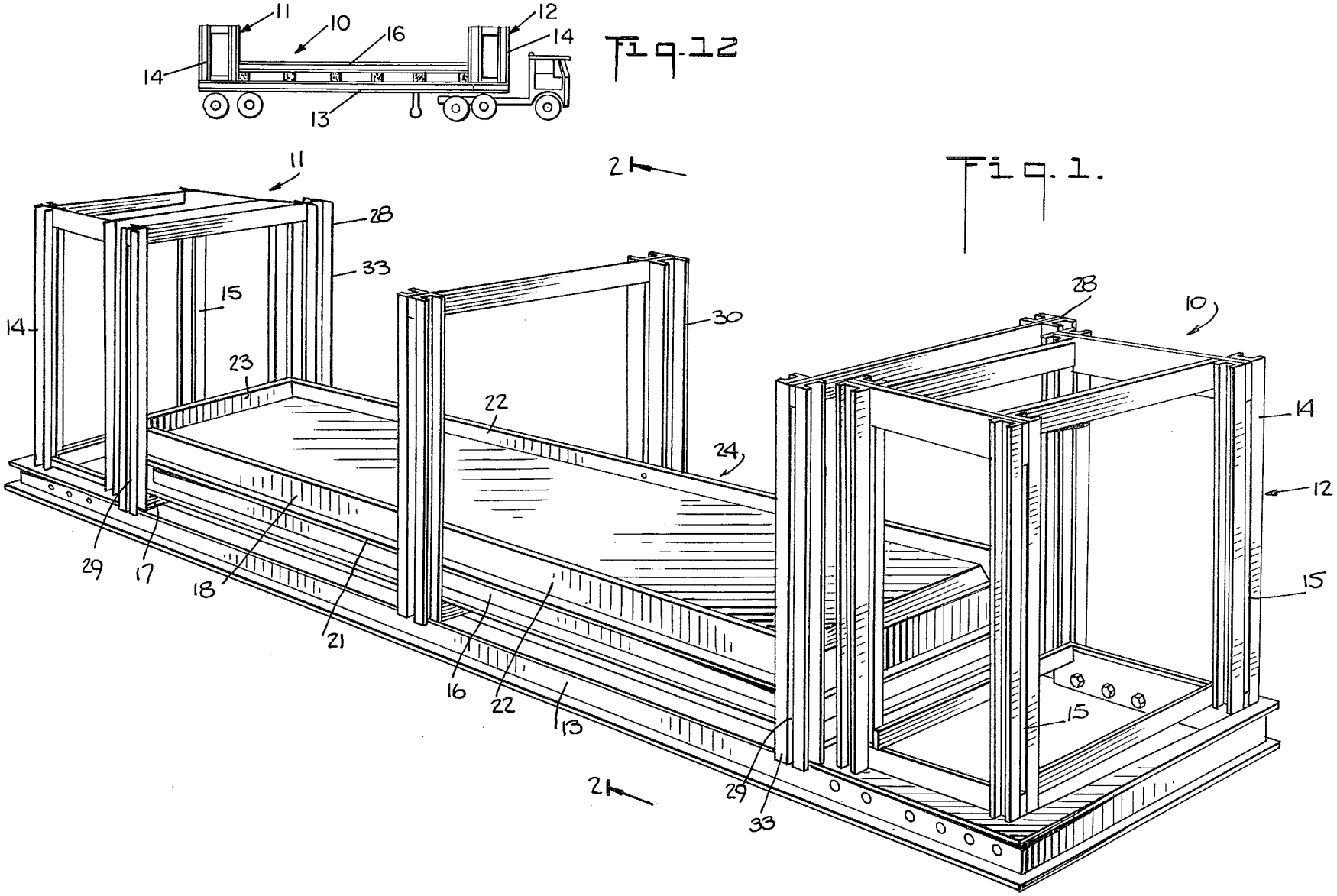
FIG. 1 is a prospective view of the apparatus according to the invention with a mold frame in position for pouring.
FIG. 12 is a view of a flat bed trailer truck showing the apparatus including a portable carriage for supporting and transporting its stressing and molding portion.
Figure 2:
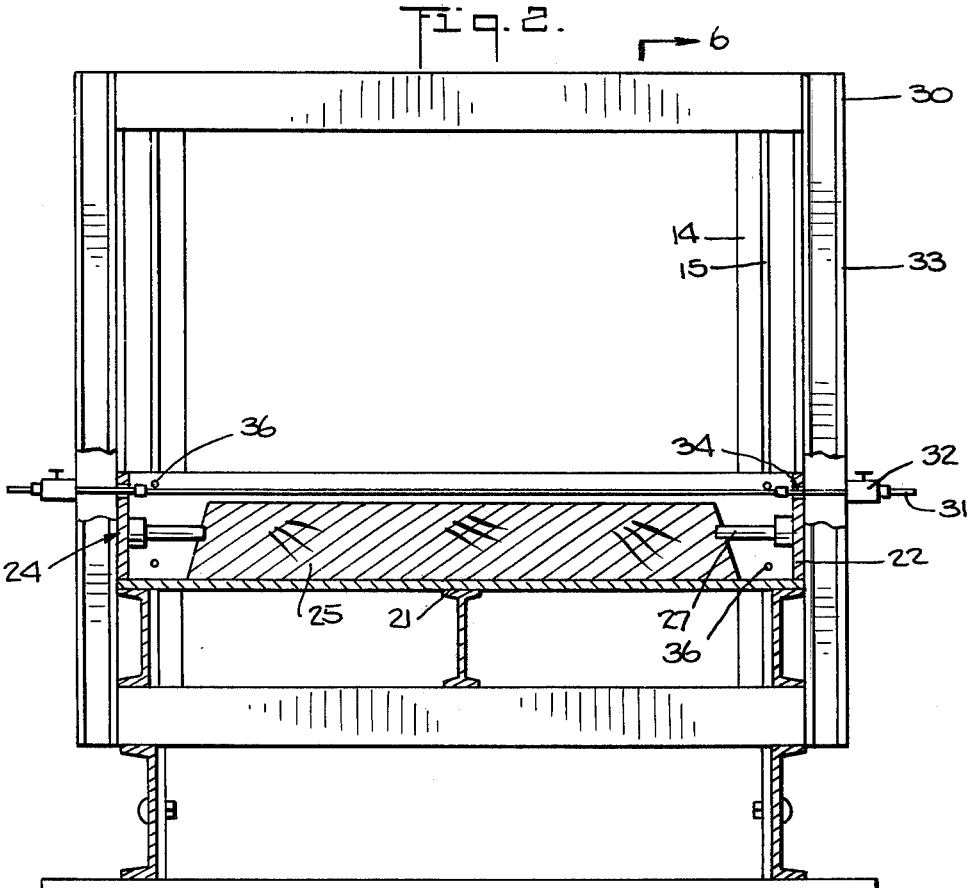
FIG. 2 is a sectional view through lines 2—2 of FIG. 1.

Portable apparatus for molding prestressed concrete forms is shown generally as 10. The apparatus shown in this embodiment can mold six concrete panels or slabs in successive pours, one above the other at the construction site. The costs associated with a crane and other equipment for orienting the molded slabs, six at a time, to a vertical position and moving them into place is reduced by up to a factor of six. Moreover, other large concrete slabs must be individually transported from the factory to the construction site — this invention need only transport the apparatus shown for molding them. 1,000 large panels shipped from the factory require 500 trucks, at two panels per truck. We ship 10 apparatus, each of which will cast five panels per day or a total of 50 per day, 20 working days. The transportation cost relates to 10 trucks which is an appreciable savings.

The apparatus comprises a lower carriage 13 having a stressing portal 12 bolted at one end and an anchor portal 11 bolted at the other end. The rectangular box-shaped stressing portal 12 and the rectangular box-shaped anchor portal 11 are structurally the same, differing only in that the stressing portal is longer longitudinally than the anchor portal. The vertical members 14 of each portal are each a pair of "C" channels placed back-to-back and spaced apart to have a slot 15 between them. The purpose of the slot 15 is to allow longitudinal stressing bars or reinforcing rods to pass through at any place along the vertical height of the slot 15, which is a substantial portion of the height of the portals 11, 12.

Spaced above the lower carriage 13 and secured at its ends to supports 17 on the lower carriage is a horizontal rectangular upper carriage 16. The upper carriage in turn supports the lowest mold form 18 of six tiers of similar mold forms, three of which, 18, 19, 20 are shown in place in the apparatus 10. The lowest mold form 18 rests upon and is supported by a steel bottom plate 21 which rests upon the upper carriage 16 and provides one mold surface for molding the lower face of the lowest concrete slab 26 to be molded in the apparatus.

Each mold form 18, 19, 20 is comprised of side members 22 and end members 23 which are secured together at their ends and arranged in the form of a longitudinal running, horizontal frame 24 to fit in the apparatus between the portals 11, 12. For these side and end members I have used the C-channel curbs for screed work, whose size and structural properties are advantageously suited for this molding apparatus.

The side members 22 and end members 23 are positioned individually into the apparatus and once there, are secured together by conventional means such as bolting. In this way, one or two men can install very large frames 24 in a ready manner. The side members 22 can be employed in different lengths over a wide range. Each of the end members 23 for this embodiment are 8 feet long. The side members 23 may be selected in length from 4 to 32 feet so that the finished slab may be from 4 × 8 to 8 × 32 feet.

Within the frame 24 and resting upon the steel bottom plate 21, a wood form 25 is centrally positioned to provide the cavity in the finished molded slab. The wood form 25 is held in position spaced on all sides from the frame 24 by hollow knock-out pins 27. These pins 27 also provide holes 28 through the finished slab 26 which are used to secure slabs to adjacent slabs or other structural members and to the foundation for holding the slabs in vertical orientation, as will be further described hereafter. Instead of a solid wood form 25, the slab cavity can as readily be formed by an inverted hollow pan 55. The knock-out pins which have central longitudinal holes 54 are driven into the cavity after the concrete slab has cured.

At each end of the upper carriage 16 and bolted to the supports 17 are rectangular end bents 28 which are vertical frames, the vertical members 33 of which, like the vertical members of the portals 11, 12 are C-channels spaced back-to-back to provide a slot 29 between. The purpose of the slot 29 is to pass transverse reinforcing rods or stressing bars at any point over a substantial part of the height of the bent 28.

Between the end bents 28, one or more sliding bents 30 can be positioned depending upon the reinforcing or prestressing desired in the transverse direction. In the embodiment shown a sliding bent 30 is positioned at about the midpoint of the mold frame 24 for passing a reinforcing rod through the finished slab 26 at that point. The sliding bent 30 and the end bents 28 are of the same configuration except that the sliding bent 30 is not fixed in position in the apparatus.

After the mold frame is installed on the steel bottom plate 21 and the wooden form 25 is installed in place, reinforcing rods 31 are inserted into the mold frame 24 through the slots 29 in the sliding bent 30 and the end bents 28 and holes 34 in the side members 22 of the mold frame 24.

Figure 8:
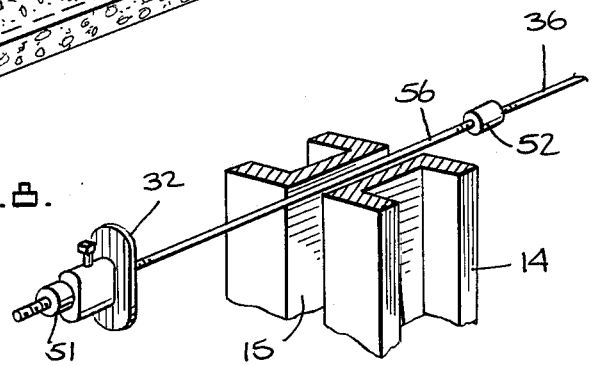
FIG. 8 is a detailed perspective view of a vertical member of the apparatus and stressing devices.

The rods 31 are stressed by stressing bolts 51 connected through an intermediate stressing rod 56 and coupler 52 and held in a stressed condition by locking members 32 which butt up against the vertical member 33 of the bents 28, 30. (FIG. 8).

Similarly, longitudinal reinforcing rods 36 are passed through the slots 15 in the vertical members 14 of the portals 11, 12 and holes 35 in the end members 23 of the mold frame 24. The reinforcing rods are stressed by bolts 51 and held in position against high-stressing tensions by locking members 32.

Figure 3:
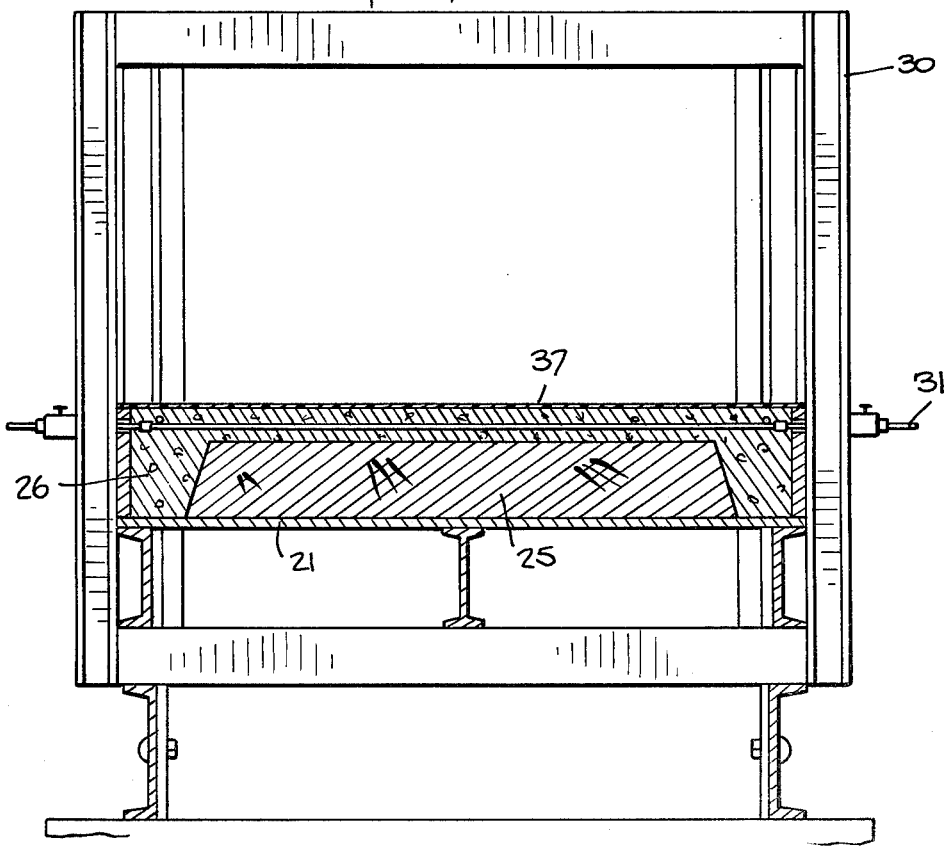
FIG. 3 is a similar sectional view to FIG. 2 following a pour.

At this point, the mold is ready to pour the first slab 26. Following a period for curing the slab 26, a polyethelene plastic sheet 37 is placed thereon to separate that slab from the slab to be poured above it. (FIG. 3).

A second mold form 38, constructed like the mold form 24 is installed between the portals 11, 12 and a second wooden form 39 is positioned within it.

The mold form 38 and the wooden form 39 rest upon the plastic sheet 37 and are supported by the upper surface of the poured concrete slab 26 which has been smoothed following the first molding operation.

Since the apparatus is open and easily accessable with respect to any mold form tier, I have found that the vibratory and surface-smoothing equipment used in screed work is quite suitable for smoothing the upper surface of each molded slab. Using, for example, a seven-bag mix of cement per cubic yard of concrete, a very smooth surface is obtained.

A second pre-stressed slab 40 is then molded on the first slab 26.

Figure 4:
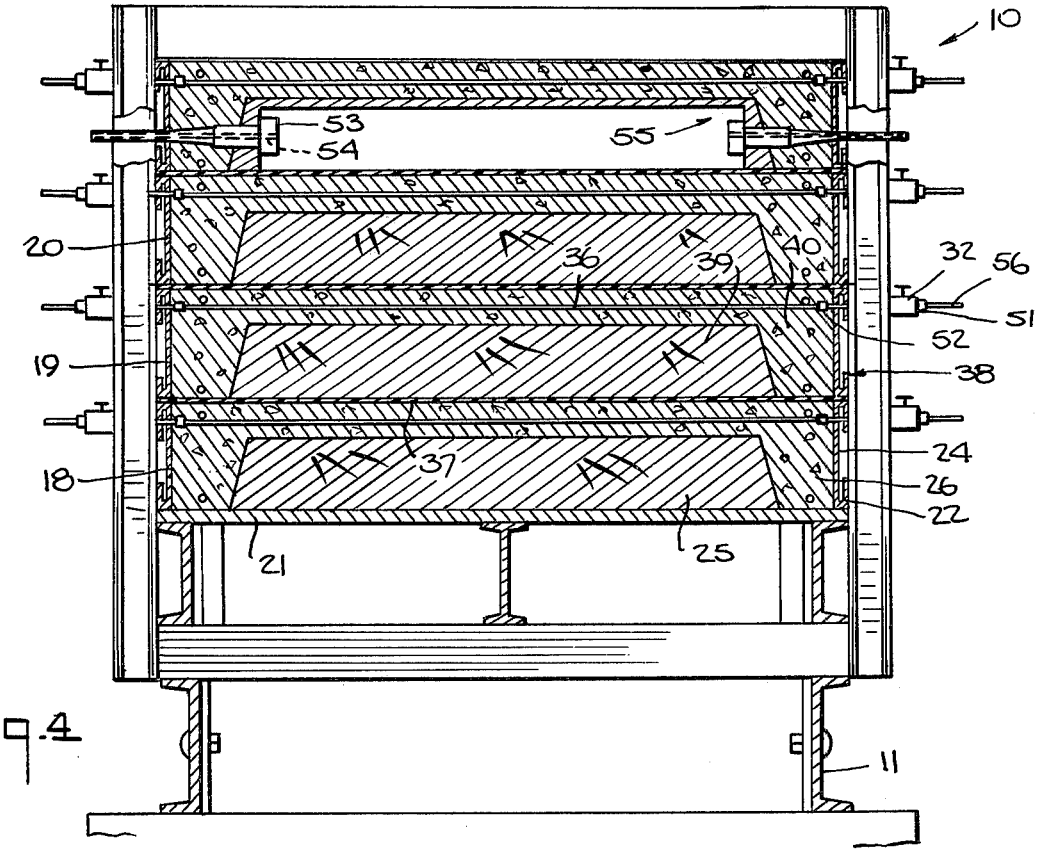
FIG. 4 is a similar section view to FIG. 3 following several successive pours.

Additional slabs, up to six in this embodiment, are successively molded in the same way, allowing about one-half hour of curing time between molding each slab. (FIG. 4).

With two apparatus of the type described, one can be set up for pouring while the other is curing, for efficient use of men an equipment.

After about 24 hours the concrete slabs achieve a strength of about 2000 psi. Using an autoclave in association with the apparatus, the same results can be achieved in about four hours. For this purpose, the hollow knock-out pins 27 together with hollow slab cavity pans serve an additional use as a means for passing steam into the interior of the mold.

The knock-out pins 27 serve four purposes:

1. To place the cavity forms in proper location.
2. To provide holes for anchor bolts or tie rods.
3. To pass steam into the enclosed cavity through holes 54 to maintain controlled temperature (160°–180°) for accelerated curing of concrete.
4. To transmit vibration to inner form for smooth interior finish.

Figure 5:
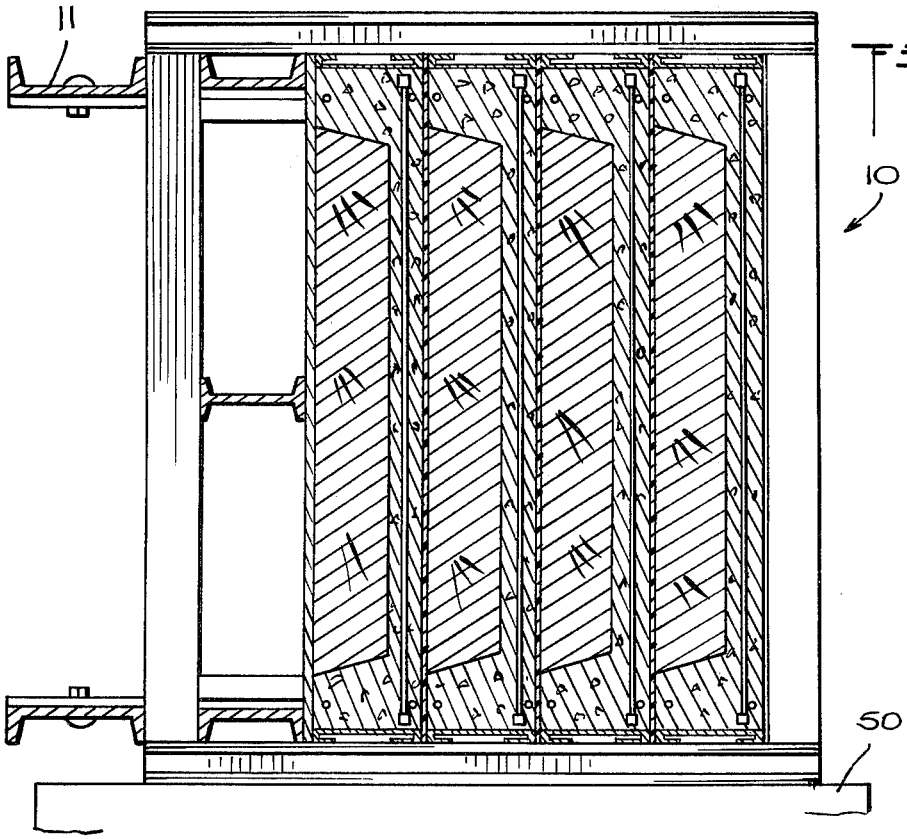
FIG. 5 is a view according to FIG. 4 showing the apparatus turned on its side to facilitate removal of the molded slabs.
Figure 6:
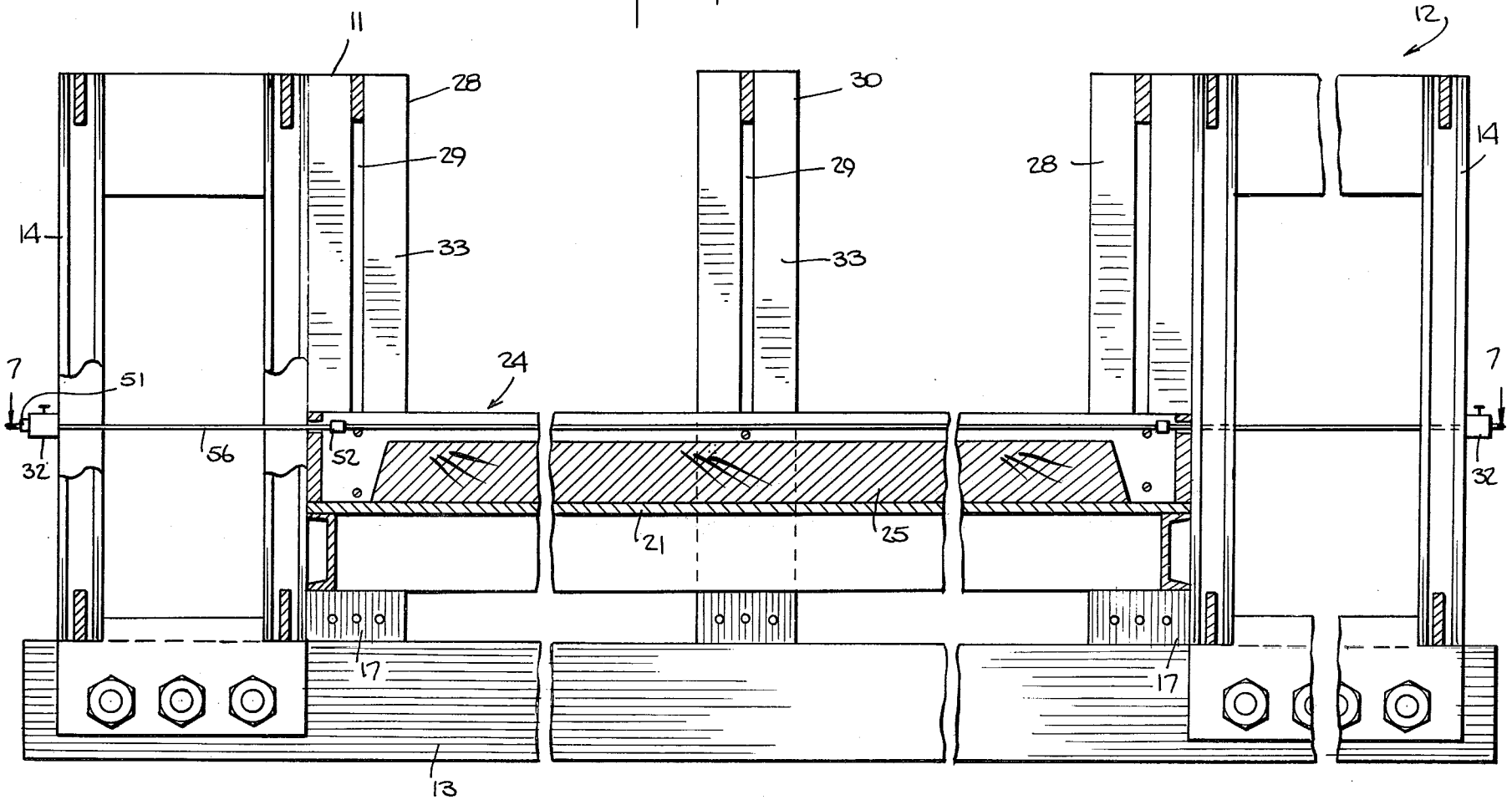
FIG. 6 is a broken longitudinal sectional view of the apparatus taken along line 6—6 in FIG. 2.
Figure 7:
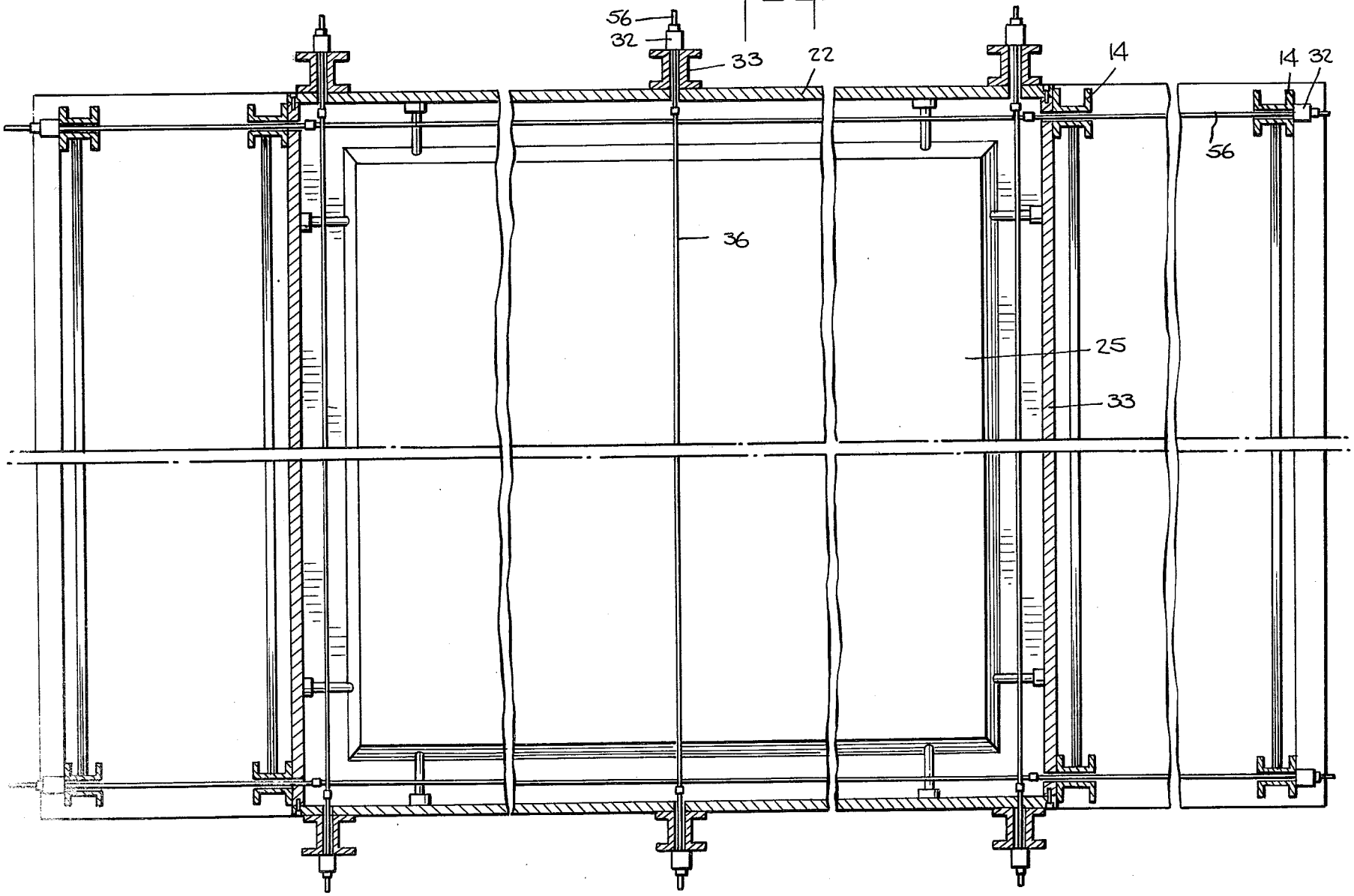
FIG. 7 is a sectional view taken along lines 7—7 in FIG. 6.

After the full complement of slabs have been molded in the apparatus 10 and have been allowed to set to adequate strength and hardness, the entire apparatus is tilted on its side so that the slabs are oriented vertically all at the same time. (FIG. 5). The apparatus rests on its side on railroad ties 50 so that the bents can be removed. Then the sliding bents 30 and end bents 28 and mold frames 24 are removed and the slabs can be removed vertically from the apparatus and moved into position in the structure under construction.

The slabs are lifted out of the apparatus in vertical orientation by a crane. In this columnar orientation concrete slabs have their greatest strength. Conventional horizontally poured concrete slabs are raised up by cranes in and from a horizontal, span-like orientation, providing much less strength for the lifting and positioning process. Thus, by tilting the entire apparatus 10, 90° onto its side before lifting the slabs, the apparatus 10 can provide larger slabs of greater strength and require less time for curing in place before positioning at the structure under construction.

Figure 9:
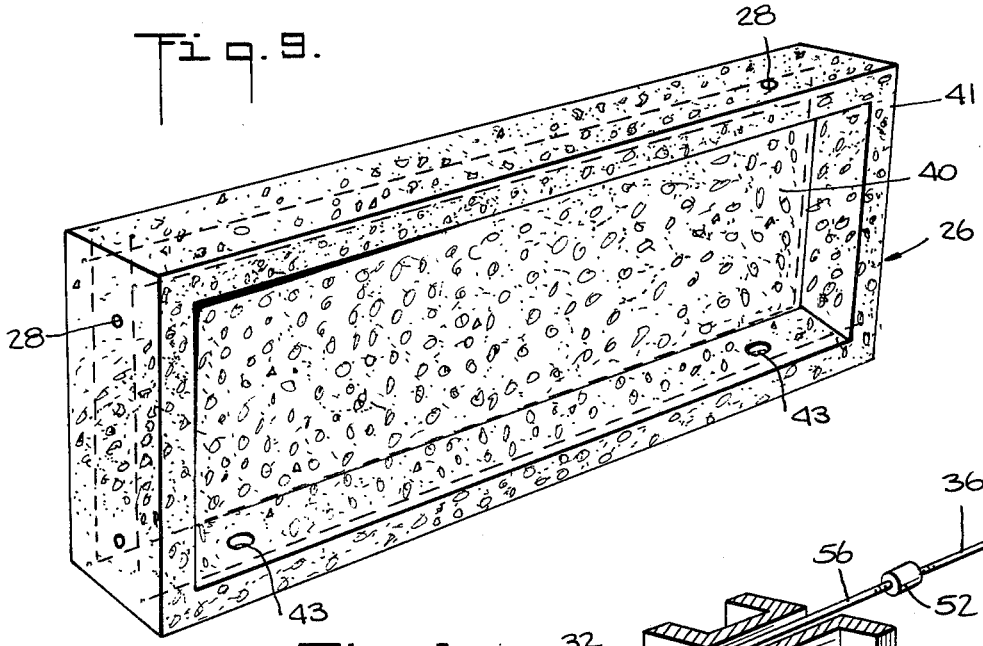
FIG. 9 is a prestressed concrete slab made according to the invention.

The slab 26 is comprised of a thin web 40 and a thicker flange 41 which frames the web 40 on all sides. This configuration is particularly suited as a universal configuration for both walls and floors. At places along the flange 41, cylindrical holes 28 with larger concentric cylindrical holes 43 for bolt heads pass through the flange. These holes are formed by the knock-out pins 27 in the mold. After curing and disassembly from the mold, the knock-out pins are driven out of the slab leaving the holes described. (FIG. 9).

Figure 10:
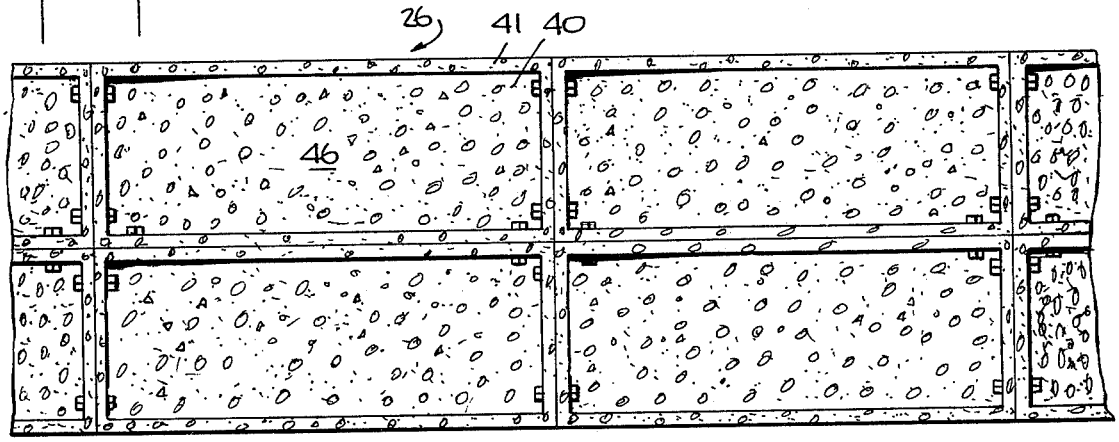
FIG. 10 shows a group of slabs secured together as a concrete wall.

In conventional pre-stressed concrete construction, concrete wall members are raised from the horizontal by cranes and then held in position by bracing members attached at one end to devices embedded in the ground and at the other end to holding devices cast and embedded into the concrete slab. In this invention, the concrete slab 26 is held upright by anchor bolts through the flange holes 28 into the foundation. The slab 26 can be secured to adjacent slabs and other adjacent structural members by bolts through horizontal holes 28. (FIG. 10).

The ability to pre-stress the concrete slab with reinforcing rods 31, 36 longitudinally and transversely in the apparatus 10 by virtue of the portals 11, 12 in one direction and the bents, 28, 30, at 90° thereto, is particularly suited to molding the universal slab 26. Stressed rods 36 reinforce the flange 41 of slab 26 in one direction and stressed rods 31 reinforce the flange 41 (and the web 40) at right angles thereto. The entire flanged frame of the slab 26 which is intended to carry a substantial part of the load, is reinforced.

Figure 11:
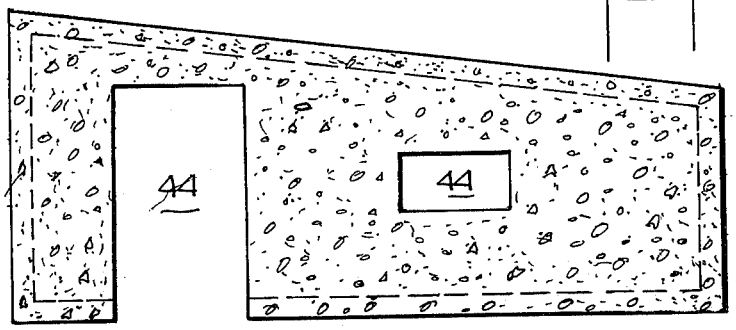
FIG. 11 is a prestressed concrete wall according to the invention with some variations in design.

The same universal slab 26 can be readily modified in the mold to provide openings 44 for windows, doors (FIG. 11) and the like and the cavity 46 within the flange 41 provides room and flexibility for running and retaining the service facilities such as ducts, conduits and the like associated with buildings. The web 40, especially with seven-bag cement mix per cubic yard of concrete, provides a surface smoothness adequate for painting as a finished wall with very little additional labor effort.

Concrete is a poor insulator, and therefore, if the walls are 2 inches thick or 8 inches thick, they require insulation. Poured in place concrete uses usually five bags of cement per cubic yard and gives 3,000 to 4,000 psi of compression strength after 28 days. Seven bags of cement per cubic yard is more expensive but gives a compression strength of 6,800 to 7,200 psi and thin members can save money by weight of concrete used. Economy is relative to minimum labor, versatile equipment, minimum material (by weight) and maximum surface area. These conditions are provided by this apparatus in which a concrete wall of 2.5 inches thickness provides 7,000 psi or 17,500 lbs. per linear inch of wall. This is quite adequate for any low-rise construction. With two apparatus, which are low in cost compared to other precasting machines, 10 slabs of 8 feet by 32 feet can be poured per day compared to six slabs of the same size using poured-in-place forms.

Advantageously, the width of the carriage 16 and portals 11, 12 will accommodate slabs of 8 feet. Positioning the sliding bents 30 relative to the portals and selecting the corresponding lengths of side members 22 of the mold form 24 will allow molding universal slabs in any size in the range of 4 feet by 8 feet through 32 feet by 8 feet in a single apparatus 10, dimensioned to accommodate slab lengths up to 32 feet. Of course, the apparatus 10 can be dimensioned to provide other slab dimensions, but for the widest range of application, an apparatus 10 dimensioned to provide slabs of 8 feet by 4 foot multiples up to 32 feet will produce slabs having the greatest potential usefulness. Structural designs based on 4 feet and 8 feet lengths and multiples of length provide a very efficient use of the multi-slab molding capability of the apparatus.

The portability of the apparatus 10 is emphasized in FIG. 12. The dimensions of the apparatus 10 can, theoretically, be anything but I have selected for good portability, the limitations imposed on full trailers and trucks. One must obtain a special license to move heavy equipment on the roads, but with the overall length of the apparatus 10 of 55 feet, the width of 8 feet and the height of less than 13 feet 6 inches, the apparatus 10 can go anywhere without a special license. For this reason, the lower carriage has dimensions of 40 feet long by 8 feet wide and the apparatus is 10 feet high. The sliding side bents are unbolted and taken apart during transportation. Since a crane is used with this apparatus 10 assembly and disassembly is not difficult.

I claim:

1. An apparatus for prestressing a plurality of steel rods for molding a plurality of concrete forms having prestressed flanges for deep beams and columns comprising an elongated carriage, a first structural portal means and a second structural portal means spaced apart towards opposite ends of said carriage and supported thereon, each of said structural portal means having a plurality of unitary upstanding structural members providing continuous vertical slots over a substantial portion of the length of the unitary structural member to receive steel stressing rods at any vertical position within a range of the continuous vertical slots, which rods run longitudinally over said carriage, and providing surfaces against which rod engaging chucks are supported, a plurality of members supported on said carriage in the space between said first and second portal means, cooperating to shape a plurality of concrete forms one above the other, said members having openings for receiving the steel stressing rods therethrough and, separating means operatively associated with the concrete form shaping members to permit the molding of said concrete forms one above the other, at least a third structural portal means supportable on said carriage at any predetermined position between the first and second portal means and comprised of a plurality of structural members spaced apart in a frame and providing vertical slots to receive steel stressing rods running transversely over said carriage at any predetermined position within the range of the vertical slots and providing surfaces against which rod engaging chucks are supported, said carriage being comprised of upper and lower carriage portions and said third structural portal means being arranged for sliding movement along said carriage between said carriage portions and secured at any selected longitudinal position between the first and second portal means.

2. An apparatus according to claim 1 in which at each end of said carriage, said first and second structural portal means is each comprised of first and second upstanding structural members secured on said carriage and spaced apart in the longitudinal direction, each of said first and second structural members providing vertical slots, mutually aligned to receive the longitudinally running steel stressing rods, the longitudinally outermost structural member in each of said structural portal means providing said chuck supporting surfaces.

3. An apparatus according to claim 1 in which each of the structural members comprise a pair of parallel members supported on said carriage and spaced apart somewhat to provide the vertical slots.

4. An apparatus according to claim 1 in which said concrete form shaping members are shaped to form pockets in the concrete forms and further comprising means operatively connected to said concrete form shaping members for passing hot air and steam to them to heat-up the concrete form for accelerated curing.

5. An apparatus according to claim 1 in which said concrete form shaping members comprise side members and end members placed individually between said first and second structural portal means and secured together at their ends.

6. An apparatus according to claim 1 in which said separating means comprise sheet means positioned between successive tiers of concrete form shaping members to facilitate the molding of concrete forms one above the other.

7. An apparatus according to claim 5 in which said side members and end members are comprised of C-channels.

8. An apparatus according to claim 1 in which said upstanding structural members are positioned to accommodate concrete form shaping members for shaping concrete forms of about eight feet in one dimension and within a range of 4 to 32 feet in the direction transverse thereto.

9. An apparatus according to claim 1 in which said concrete form shaping members are shaped to form pockets in the concrete forms and comprising tapered knock out pin means secured to said concrete form-shaping members for providing cavities in said concrete form leading to said pocket in said concrete forms.

10. An apparatus according to claim 9 in which said knock-out pin means are hollow.

11. An apparatus for molding a plurality of prestressed concrete forms with thick flanges for deep beam and column structures comprising a plurality of mold forms, means comprising upper and lower portions supporting said plurality of mold forms one upon the other for sequentially casting prestressed concrete forms in said plurality of mold forms, means supported by said supporting means for positioning and stressing a plurality of steel stressing rods through said plurality of concrete forms in said plurality of mold forms, means positioned between said mold forms for separating one concrete form from the concrete form to be cast above it, said positioning and stressing means comprising a pair of structures spaced apart and having opposed upstanding means for receiving a plurality of steel stressing rods at successive tier heights for passage through successive mold forms placed one above the other in the apparatus for successively molding said plurality of prestressed concrete forms, each of said opposed upstanding means being connected in a frame which is supported between said upper and lower portions for sliding movement along said mold forms to a position determined by the desired location of the reinforcing means for the final concrete form, and said upstanding means being secured at said desired location to said supporting means.

12. An apparatus according to claim 11 comprising upstanding means supported by said supporting means for positioning a second plurality of steel stressing rods through said plurality of concrete forms in a direction transverse to the first plurality of steel stressing rods.

* * * * *